US008205769B1

(12) United States Patent
Gaspari et al.

(10) Patent No.: US 8,205,769 B1
(45) Date of Patent: Jun. 26, 2012

(54) COMPARTMENTED DISPENSING CONTAINER

(76) Inventors: Seda Gaspari, Los Angeles, CA (US); Mike H. Ananighian, Los Angeles, CA (US)

( * ) Notice: Subject to any disclaimer, the term of this patent is extended or adjusted under 35 U.S.C. 154(b) by 0 days.

(21) Appl. No.: 13/181,430

(22) Filed: Jul. 12, 2011

(51) Int. Cl.
*B65H 1/00* (2006.01)

(52) U.S. Cl. ..... 221/34; 221/44; 221/45; 221/49; 221/65

(58) Field of Classification Search ..... 221/34, 221/44, 45, 46, 49, 65, 305
See application file for complete search history.

(56) References Cited

U.S. PATENT DOCUMENTS 3,137,437 A * 6/1964 Svensson ..... 229/101.1
3,145,840 A * 8/1964 Wright ..... 221/65
3,224,633 A * 12/1965 Allen ..... 221/48
3,403,815 A * 10/1968 Robson ..... 221/34
3,539,093 A * 11/1970 Massengill ..... 206/820
3,744,448 A * 7/1973 Boone ..... 221/69
4,091,929 A * 5/1978 Krane ..... 229/206
4,919,269 A * 4/1990 Wright et al. ..... 229/120.011
5,050,737 A * 9/1991 Joslyn et al. ..... 221/49
6,213,345 B1 * 4/2001 Plank ..... 221/46
7,273,156 B2 * 9/2007 Gao et al. ..... 221/47

* cited by examiner

*Primary Examiner* — Timothy Waggoner
(74) *Attorney, Agent, or Firm* — Patent Law & Venture Group; Gene Scott

(57) ABSTRACT

A container for storing and dispensing consumable products. Modular construction is utilized wherein there is one base container and at least one subcontainer mounted above the base container. The base container has a floor, a peripheral wall, and a cover panel. Each subcontainer has a peripheral wall and a cover panel, and is coupled to a container below, such as the base container or another subcontainer, in stacked fashion. The cover panel of that container immediately below forms the floor of the container above, thereby obviating the necessity of forming a floor in each container. Each container may have a closure to enable contents to be withdrawn therefrom. The various containers are coupled together to form a stack by a removable band. When contents of the uppermost container are depleted, the empty container is removed from the stack to reveal the next container.

4 Claims, 8 Drawing Sheets

COMPARTMENTED DISPENSING CONTAINER

FIELD OF THE INVENTION

The present invention relates to containers for dispensing sheet or web materials such as tissue paper, granular substances, small objects, and the like, and more particularly to a modular container having removable sections. Removal of one section reveals a subsequent modular section.

BACKGROUND OF THE INVENTION

Many consumable materials and articles are provided to consumers in containers which are used to store and dispense the materials and articles until depletion. Some types of materials and articles must be carefully protected from contamination or spoilage in order to obtain the maximum utility.

In one example, personal sanitary articles such as facial tissues are typically stored in and dispensed from inexpensive paperboard boxes. The paperboard box typically has a frangible closure which once removed exposes the top facial tissue of a stack of facial tissues. The user tears open the closure and grasps and removes the first or top tissue.

This type of container is typically used to dispense sanitary articles. A person needing a sanitary article may likely have hands contaminated by germs, objectionable substances, and the like. Therefore, when reaching into the container, the germs or objectionable substances may become transferred to the remaining tissues which themselves will obviously become contaminated.

Usually, this is not a problem when the first several tissues are removed. However, as the supply of tissues is progressively depleted, the user must reach farther and farther into the container to reach the next available tissue. As his or her hand must extend farther and farther into the container, the likelihood of contamination of the box and the remaining supply of tissues increases.

One solution to this problem would be to provide tissues in shallow containers. However, this obliges the consumer to purchase smaller boxes of product, with attendant increased costs in packaging for the number of tissues or other product purchased.

In a second example, consumable products such as food products may be subject to spoilage if exposed to nothing more than ambient air. Such food products, including coffee, pet foods, and many others, may be packaged in large containers which require a while to be fully consumed. After an initial portion is consumed, the remainder may start to spoil or merely to lose freshness if left in the can or other package until it is consumed.

Alternatively, single portions may be individually packaged. This overcomes the issue of spoilage and loss of freshness, but requires one entire container which is discarded after only one portion is consumed.

There exists a need for a container of tissues to both protect against contamination when reaching for the next tissue, while still enabling consumers to have commercially available relatively great supplies of tissues.

There also exists a need in the field of products of limited life once the container is opened, wherein the container accommodates small portions, yet minimizes costs of such accommodation.

SUMMARY OF THE INVENTION

The present invention provides a modular approach to packaging of materials and articles which must be protected in various ways, while limiting costs of the packaging. In the modular approach, a container comprises plural modules which provide shared walls. Upon depletion of the product in a first module, the first module is removed from the remaining modules and discarded. One wall of the module is provided by the wall of the next module, thereby minimizing costs of each module.

In the example of tissue dispensing, there is presented tissue packaging in a container which takes the form of stacked or tiered smaller subcontainers. This is different from the concept of providing many shallow individual containers and packaging them in common. The significant difference is that with the exception of the bottom subcontainer, none of the subcontainers has a floor. Instead, the floor is provided by the uppermost panel of the next subcontainer in the stack.

Individual subcontainers are secured together in the stack by a removable band of tape. When the supply of tissues within the top or uppermost box is depleted, the tape is removed to expose the next subcontainer. Lack of a floor panel in all of the subcontainers except the last in the stack conserves constituent material of each subcontainer, thereby reducing costs compared to providing a stack of self-enclosed, independent containers, while also reducing the amount of generated waste.

The novel arrangement enables generally conventional packaging of tissue type articles, while overcoming the above noted problem of contamination, while minimizing costs of containers and waste generated thereby.

In the example of products which must generally be maintained under air tight conditions, the same principle may be utilized. For example, products traditionally provided in metallic cans may be provided in modular cans joined in a stacked array. The top panel of any one can may serve as the floor for the can above it. When one can is opened and its contents depleted, that can is removed from the stack to reveal a subsequent can. The depleted can may be manufactured without a floor panel as the upper panel of the next can module serves both the functions of floor for the upper can module and upper panel for the lower can module.

It is an object of the invention to provide a container for tissue type articles which overcomes the problem of contamination arising when a user inserts his or her hand deep into the container.

Another object of the invention is to minimize the cost of individual containers where many small containers are utilized to package consumable products.

A further object is to minimize the amount of constituent material used when providing a stack of containers coupled to one another.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
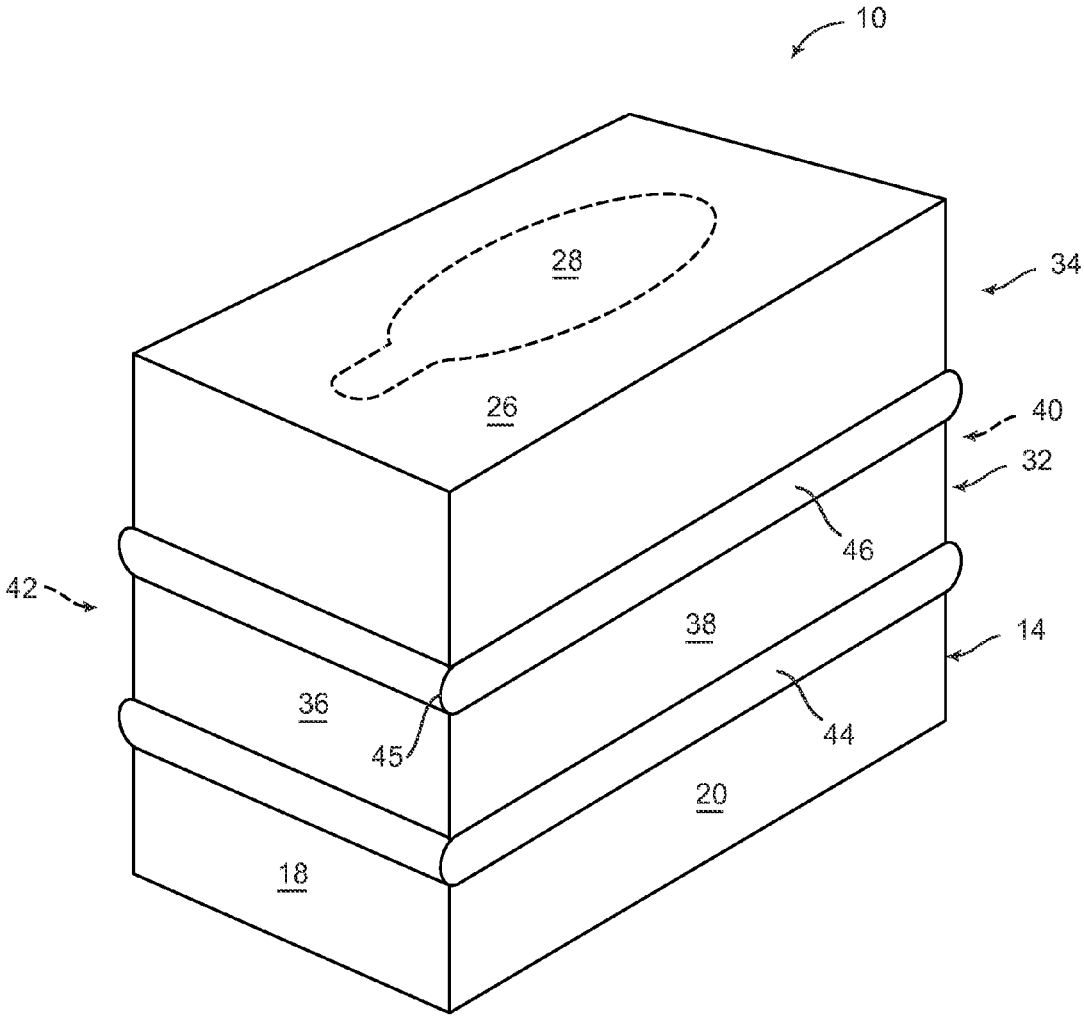
FIG. 1 is a top perspective view of a modular container for storing and dispensing web sheets according to at least one aspect of the invention.
Figure 2:
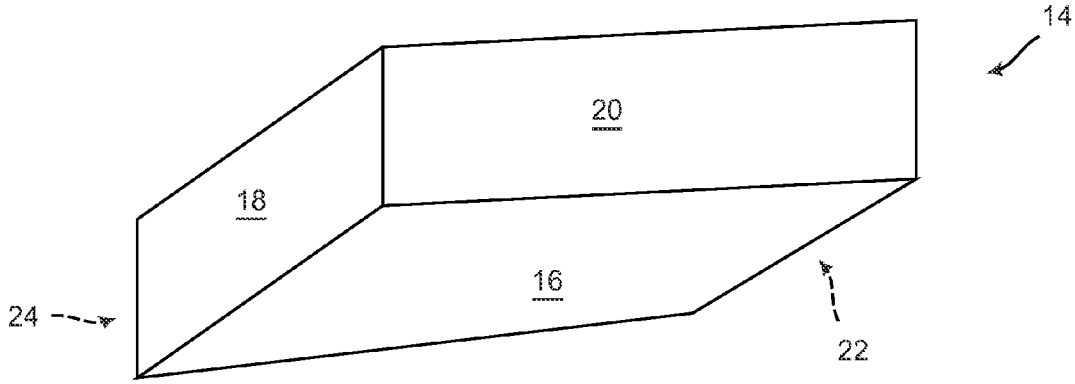
FIG. 2 is a bottom perspective view of the bottom module of the modular container of FIG. 1.
Figure 3:
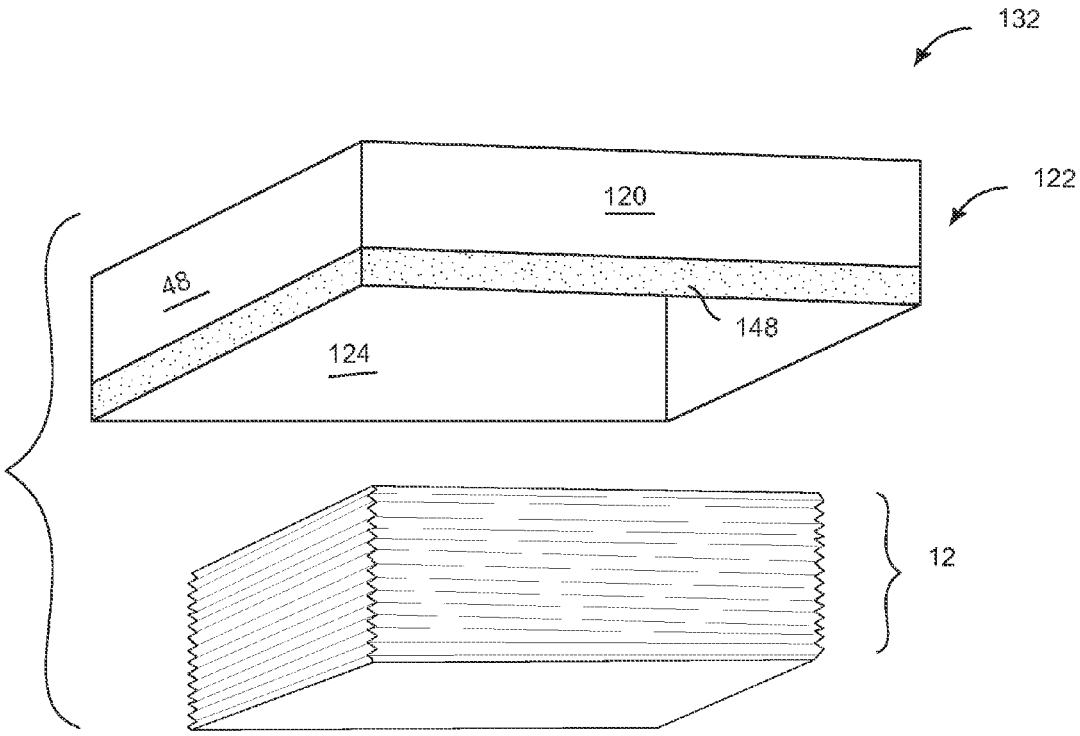
FIG. 3 is an exploded bottom perspective view of a module of the modular container of FIG. 1.

Referring first to FIGS. 1 and 2, according to at least one aspect of the invention, there is shown a container 10 for storing and dispensing web sheets 12 (see FIG. 3). The container 10 will be understood to be modular, comprising a base container 14 and at least one detachable subcontainer such as the subcontainer 32 and optionally, one or more additional subcontainers such as the subcontainer 34. Each subcontainer such as the first subcontainer 32 is removably disposed above the base container 14. Where there are two or more subcontainers, the base container 14 and every subcontainer such as the first subcontainer 32 and the second subcontainer 34, collectively form at least three fully enclosed containers coupled in mutually stacked relationship as seen in FIG. 1. The uppermost subcontainer may be detached or removed from the remaining subcontainers as it is depleted of web sheets, thereby exposing the next subcontainer. This may continue until only the base container 14 remains.

It should be noted at this point that orientational terms such as above and below refer to the subject drawing as viewed by an observer. The drawing figures depict their subject matter in orientations of normal use, which could obviously change depending on how a container such as the container 10 is held by a person (not shown) or how the container 10 is placed on a supporting environmental surface (not shown). Therefore, orientational terms must be understood to provide semantic basis for purposes of description, and do not limit the invention or its component parts in any particular way. The container 10 may comprise a base container 14 comprising a floor 16, four upstanding walls 18, 20, 22, 24 projecting from the floor 16 so as to define a bounded space having volume disposed above the floor 16. A cover panel spans the four upstanding walls 18, 20, 22, 24 so as to cover the bounded volume. The cover panel (not visible in FIGS. 1 and 2, but similar to a cover panel 26) may be joined to or formed integrally with the four upstanding walls 18, 20, 22, 24, and may have a first openable closure (not visible in FIGS. 1 and 2, but similar to an openable closure 28) disposed to provide access to the bounded space located below the first openable closure and within the four upstanding walls 18, 20, 22, 24. It will be seen in FIGS. 1 and 2 that only one openable closure is exposed to view at any one time. The openable closure 28 may be formed by scoring of the cover panel 26 such that the openable closure 28 may be torn away and discarded. This is typical of conventional containers (not shown) for storing and dispensing facial tissues, and need not be further detailed herein.

The bounded space of the base container 20 contains a supply of web sheets (not visible in FIG. 1, but comparable to web sheets 12, as seen in FIG. 3) which are stored in and to be dispensed therefrom.

The subcontainers such as the subcontainers 32 and 34 generally have construction similar to that of the base container 14, with one important exception. The exception is that the base container 14, because when used has no associated subcontainer, must have integrally therewith all of the six walls which characterize the parallelepiped configuration it displays. By contrast, each subcontainer is devoid of a floor panel, such as the floor panel 16, which is integral therewith. A floor panel which remains with a base container or a subcontainer left behind when a subcontainer is removed therefrom is obviously not integral with the removed subcontainer, even though that floor panel has served the function of a floor when the modular containers such as the base container or subcontainer were coupled together.

Each subcontainer comprises a cover panel bearing an openable closure, such as the cover panel 26 and the openable closure 28. Each subcontainer comprises four upstanding walls each disposed parallel to at least one of the four upstanding walls 16, 18, 20, 22 of the base container 14. The four upstanding walls of each subcontainer, such as the four upstanding walls 36, 38, 40, 42 of the subcontainer 32, as seen in FIG. 3, may be similar in construction to the four upstanding walls 16, 18, 20, 22. Each subcontainer comprises a second cover panel spanning the four upstanding walls of the subcontainer, such as the cover panel 26 and its associated four upstanding walls 36, 38, 40, 42. The cover panels of the various subcontainers are disposed to provide access to space below the cover panels of their respective subcontainers and within the four upstanding walls of their respective subcontainers.

The subcontainer 32 is held above the base container 14 by a first coupling band 44, which is disposed to hold the first subcontainer 32 above and in similar upright orientation relative to the base container 14. The first coupling band 44 may comprise a pull tab 45 for grasping when pulling the first coupling band 44 free. The cover panel (not visible, but similar to the cover panel 26) of the base container 14 is disposed to close the bottom of the space located below the cover panel of the first subcontainer 32 and within the four upstanding walls 36, 38, 40, 42 of the first subcontainer 32. Alternatively stated, the cover panel of the base panel 14 or of any subcontainer forms the floor for the space of the subcontainer thereabove. Hence, each subcontainer is provided with a floor, and need not have an integral floor panel. This simplifies construction of each subcontainer and minimizes the amount of constituent material required in its construction.

A coupling band corresponding to the coupling band 44 is provided between each two subcontainers, and is disposed to hold one subcontainer above and in similar upright orientation relative to the prior subcontainer, as seen for example with the second coupling band 46 and the subcontainers 32 and 34.

The openable closure of the base container 14 and of any subcontainer, such as the subcontainer 34, may comprise a frangible, discardable panel disposed to generate an opening in the cover panel of its respective base container or subcontainer, as has been described with reference to the openable closure 28 of the cover panel 26.

The coupling bands, such as the coupling band 44, may be adhered to the base container 14 (or, in the case of the coupling band 46, which couples subcontainers 32 and 34) and may be frangibly separable from the base container 14 (or a subcontainer such as the subcontainer 32). As employed herein, "frangibly separable" signifies that the constituent material of the coupling band may be prescored and readily torn along the prescoring so as to break away and leave the previously coupled adjacent subcontainer unconnected, and ultimately discarded.

As an alternative to a frangibly separable coupling band, the same function may be provided by a tape bearing adhesive on one side (not shown) which adheres to the base section 14 and an adjacent subcontainer such as the subcontainer 32, or which adheres to two adjacent subcontainers such as the subcontainers 32 and 34.

Figure 4:
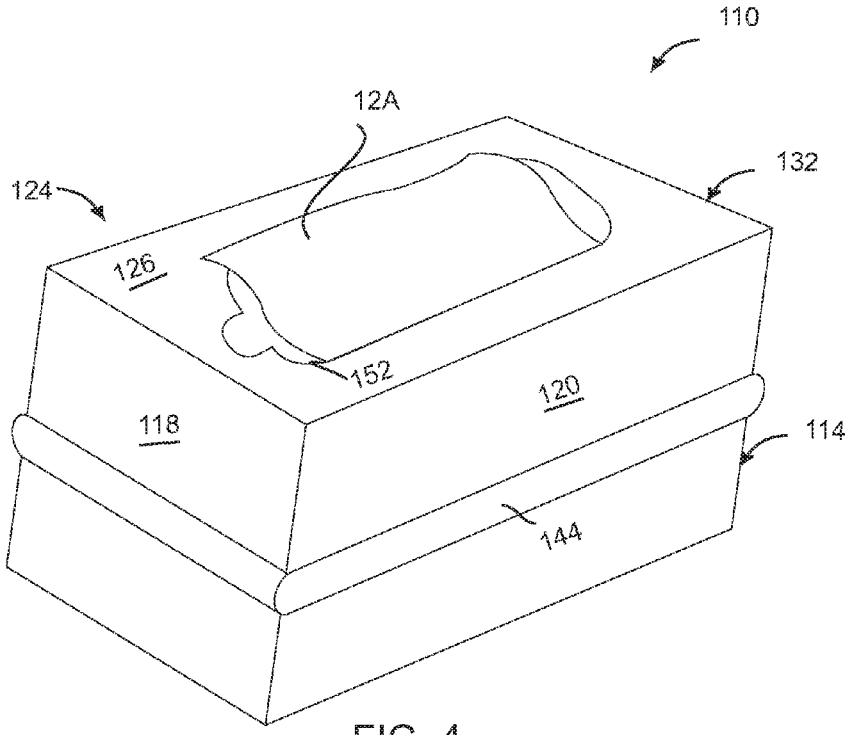
FIG. 4 is a top perspective view of a container according to a further aspect of the invention.

In a further alternative shown in FIGS. 3 and 4, a coupling band 144 may comprise a plain ribbon of paper-like constituency which bears no adhesive of its own, relying instead upon a band or zone of adhesive 148 disposed on the upstanding walls 118, 120, 122, 124 of a subcontainer 132 of a container 110. Other than the nature of the coupling band 144 and its attachment by the adhesive 148, the container 110 and subcontainer 132 may in other ways have the structure and function of the container 10 and the subcontainer 32.

FIG. 4 depicts the subcontainer 132 after its openable closure has been removed, thereby leaving behind an opening 152 through which individual web sheets such as the web sheet 12A may be retrieved. The web sheet 12A will be understood to be a single one of the supply of web sheets 12 shown in FIG. 3. The supply of web sheets 12 may be interfolded such that upon retrieval of any one web sheet such as the web sheet 12A, a subsequent web sheet (not shown) projects through the opening 152 to facilitate grasping and retrieving.

Figure 6:
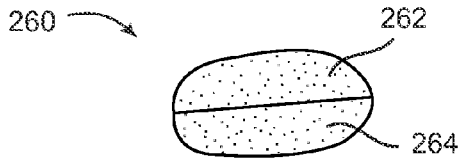
FIG. 6 is a bottom view of a component seen at the upper center of FIG. 5.
Figure 5:
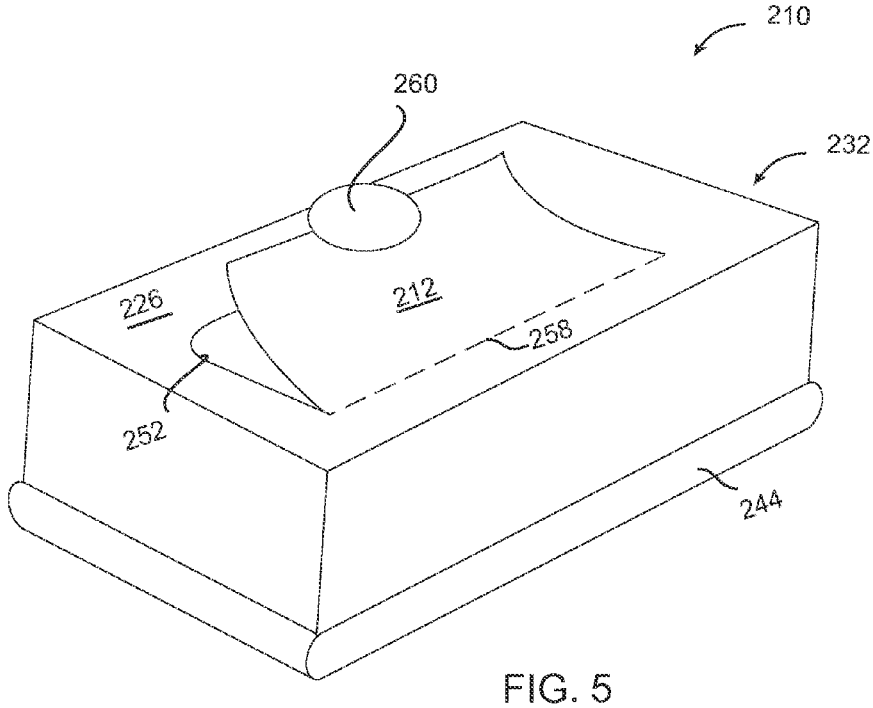
FIG. 5 is a top perspective view of a module of a container according to still another aspect of the invention.

FIG. 5 shows a variation wherein a container 210, which in other ways may have the structure and function of the container 10, has an openable closure 212 which remains attached to its associated base container or subcontainer (in the example of FIG. 5, the openable closure 212 is attached to a subcontainer 232). The openable closure 212 may separate from the cover panel 226 on three of four sides, while folding along the fourth side 258. When pulled upwardly, the openable closure may reveal an opening 252 for retrieval of web sheets such as the web sheets 12. The openable closure 212 may be releasably secured by an adhesive tab 260 for example. As further seen in FIG. 6, the adhesive tab 260 may have a first zone of strong or very sticky adhesive 262 and a second zone of weak or less sticky adhesive 264. This arrangement enables the tab 260 to be pulled free from the cover panel 226 yet remain attached to the openable closure 212.

As an alternative to the arrangement using precutting of the openable closure 212 on three sides and retention by the adhesive tab 260, the openable closure may be prescored on three sides if desired (this option is not shown).

The invention may be thought of as a container such as the container 10, or alternatively, as a container in combination with supplies of web sheets such as the web sheets 12 (see FIG. 3). Some web sheets may be stored within the base container such as the base container 14, with some additional web sheets stored within each one of the subcontainers, such as the subcontainers 32 and 34.

While the web sheets may be of any type for any desired purpose, it is contemplated that an advantageous application of the invention is provide when the web sheets are of a type serving a hygienic purpose, such as conventional facial tissues. The web sheets may be free of oils, lint, or any other objectionable influence. For example, the web sheets may be adapted for handling of sterile medical articles, film prints, glass slides, antique or collectible objects such as postage stamps and coins, and the like. If desired, the web sheets may be of a conventional type comprising an antiseptic component, such as an antimicrobial compound of the type used with commercially available wiping webs intended for use with babies.

While the container 10 described thus far comprises a base container 14 and two subcontainers 32, 34, the invention contemplates other possibilities. For example, as seen in FIG. 4, there may be only one subcontainer 132. In other implementations of the inventions (not shown), the number of subcontainers such as the subcontainer 32 may be greater than two.

Figure 7:
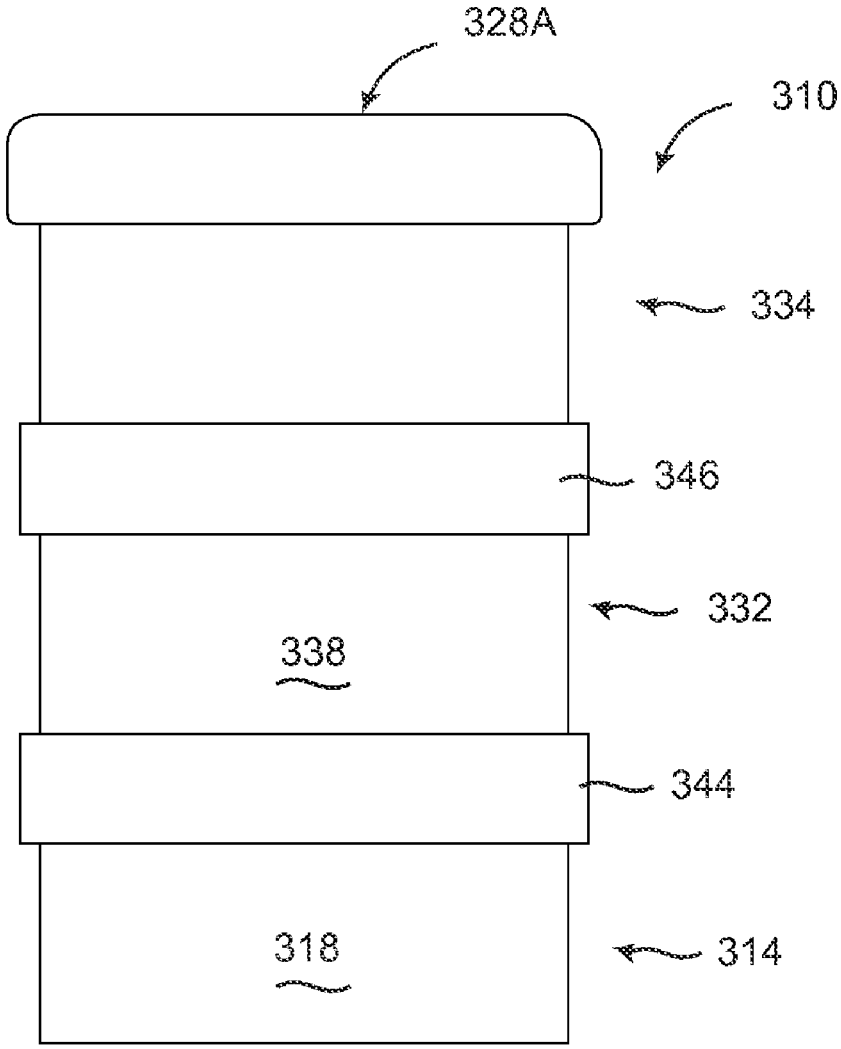
FIG. 7 is a side view of stacked subcontainers according to a further aspect of the invention.
Figure 8:
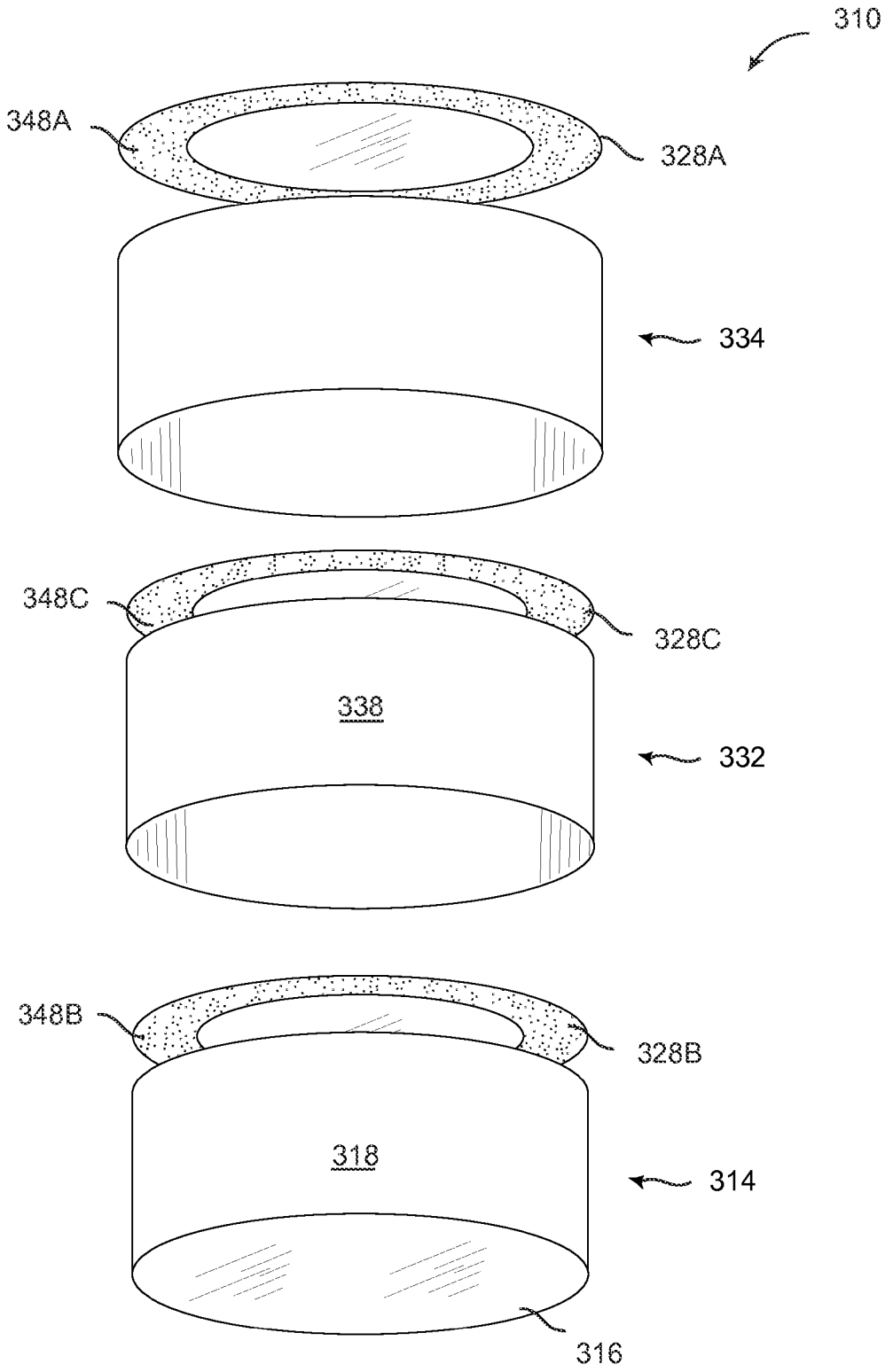
FIG. 8 is an exploded perspective view of FIG. 7.

FIGS. 7 and 8 show a container 310 for storing and dispensing comminuted substances. For the purposes of disclosure, a comminuted substance may be granular, powdered, may comprise many small discrete articles, or may be fluid. The comminuted substance will be understood to encompass those substances which are handled and dispensed in indeterminate quantities, such as is typical of fluids, or in numbers such that each individual particle or object loses its identity as a singular item in typical handling. This is typical of powders, granules, and small objects such as seeds, where the consumer has no interest in utilizing the small objects individually.

The container 310 is seen to comprise a base container 314 comprising a floor 316 (see FIG. 8), a peripheral wall 318 projecting from the floor 316 so as to define a bounded space having volume disposed above the floor 316, and a cover panel 328B spanning the bounds of the peripheral wall 318 so as to cover the bounded volume. A cover panel such as the cover panel 328B may comprise only a closure which closes the open upper end of its associated subcontainer 332 (or an associated base container such as the base container 314, of course). Alternatively, the cover panel may comprise a non-removable portion such as in inwardly turned flange (not shown) which may be fixed to a peripheral wall such as the peripheral wall 338, or may even comprise a member which fully closes and covers the open end of the associated subcontainer or base container. An example of the latter cover panel would be an integral metallic panel which is typical of convention metallic cans (not shown).

A first subcontainer 332 is removably disposed above the base container 314. A second subcontainer 334 is removably disposed above the first subcontainer 332. The first subcontainer 332 comprises a peripheral walls 338 which is disposed parallel to the peripheral wall 318 of the base container 314. A second cover panel 328C spans the bounds of the peripheral wall 318 of the subcontainer.

A second subcontainer 334 is removably disposed above the first subcontainer 332. The second subcontainer 334 may have all of the structural and functional characteristics of the first subcontainer 332, and therefore need not be further detailed herein.

It should be stressed that each of the subcontainers such as the subcontainers 332 and 334 are devoid of a floor panel which is integral therewith, as that has been defined with respect to the container 10.

The container 310 is united by coupling bands 344, 346, each of which is disposed to hold one subcontainer 332 or 334 above and in similar upright orientation relative to an the base container 318, or in the case of the coupling band 346, to hold the subcontainer 334 above and in similar upright orientation relative to the intervening subcontainer 332.

The cover panel 328B of the base container 318 is disposed to close the bottom of the space located below the cover panel 328C of the subcontainer 332 and within the peripheral wall 338 of the subcontainer 332. Thus the subcontainer 332 and the base container 314 collectively form two coupled fully enclosed containers. With the addition of the subcontainer 334, which is closed at the top by its cover panel 328A and at the bottom by the cover panel 328C of the subcontainer 332, and with the subcontainer 334 held in place by the coupling band 346, there is established a modular assembly of three coupled fully enclosed containers. The coupling bands 344, 346 may comprise tape, or alternatively stated, a flexible ribbon bearing adhesive.

The base container 314 and the subcontainers 332, 334 may each comprise substantially sheet metallic constituent material, thereby taking on the attributes of metal cans (not shown) conventionally provided to store consumer products. The base container 314 and the subcontainers 332, 334 may be circular in end view. The cover panels 328A, 328B, 328C may take on characteristics of known cans. For example, and as depicted, the cover panels 328A, 32B, or 328C may comprise foil bearing respective adhesive zones 348A, 348B, 348C, so that the cover panel may be affixed to its associated base container 314 or subcontainer 332 or 334. Alternatively, the cover panels may be integral with their respective peripheral walls, as is conventional with all metal cans. In a further alternative, cover panels may be friction fit or snap fit to their respective peripheral walls, as is known in the art (these alternatives are not shown). The cover panels may be openable in any known way so as to provide access to the bounded space of their associated base container 314 and base containers 332, 334.

A coupling band such as the coupling bands 44 and 344 may comprise a shrink wrapping if desired. This is regarded as most feasible in relatively rigid and stout containers, such as the can 310.

Regardless of whether the coupling bands 344, 346 are of the adhesive type, of the shrink fit type, or are of still other types, they may nonetheless be sufficiently air-tight so as to maintain air-tight integrity of vacuum packed contents for example.

Also, the cover panels 328A, 328B, 328C or other openable closures of the base container 314 and the subcontainers 332, 334 may be sufficiently robust to provide an air-tight seal of the base container 314 and the subcontainers 332, 334.

Figure 9:
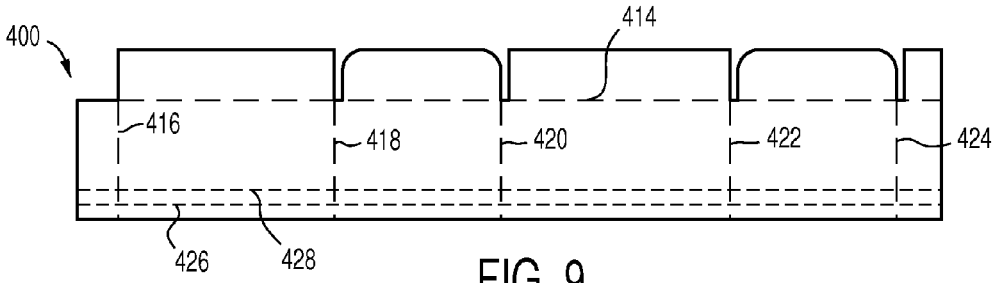
FIG. 9 is a plan view of a blank which may be folded to form a subcontainer.
Figure 11:
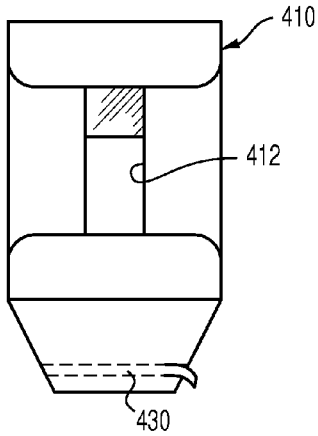
FIG. 11 is a top perspective view of a subcontainer assembled from the blank of FIG. 9.
Figure 12:
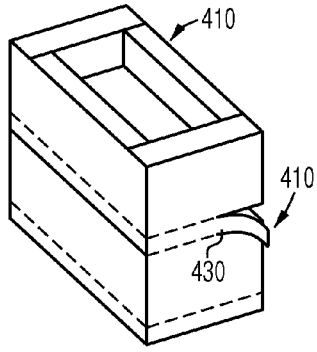
FIG. 12 is a different perspective view, showing a container made up from two subcontainers such as that shown in FIG. 11.

FIG. 9 shows a blank 400 which may be folded up to produce a subcontainer, such as the subcontainer 410 seen in FIG. 11. The blank 400 may have fold lines 414, 416, 418, 420, 422, and 424, which may comprise actual folds, or which may represent where folds are to be made. The blank 400 may also have score lines 426, 428 which will enable a strip 430 to be manually torn from the erected subcontainer 410 of FIG. 11. It will be seen that folding the blank 400 to form the subcontainer 410 results in an opening 412 through which the contents of the subcontainer 410 may be retrieved. It must also be borne in mind that the blank 400 does not provide a floor panel for the subcontainer 410, so that the subcontainer 410 may be removed from a stack of like subcontainers (not shown), just as is done in prior embodiments. FIG. 12 illustrates such a stack formed from two subcontainers 410 and having a peelable strip 430 to remove the upper subcontainer 410 from the lower subcontainer 410.

Figure 13:
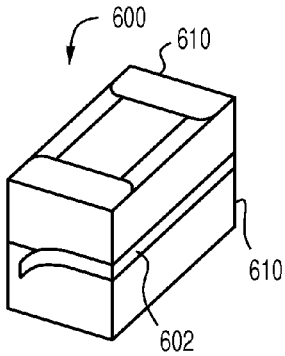
FIG. 13 is a perspective view of a container comprising two subcontainers united by a strip of material bearing adhesive.

FIG. 13 shows a container 600 formed from subcontainers 610, wherein an unscored adhesive strip 602 is used to unite the constituent subcontainers 610. The subcontainers 610 may, apart from structure for attaching an upper subcontainer 610 to a lower subcontainer 610, have the characteristics of any of the subcontainers presented herein.

Figure 10:
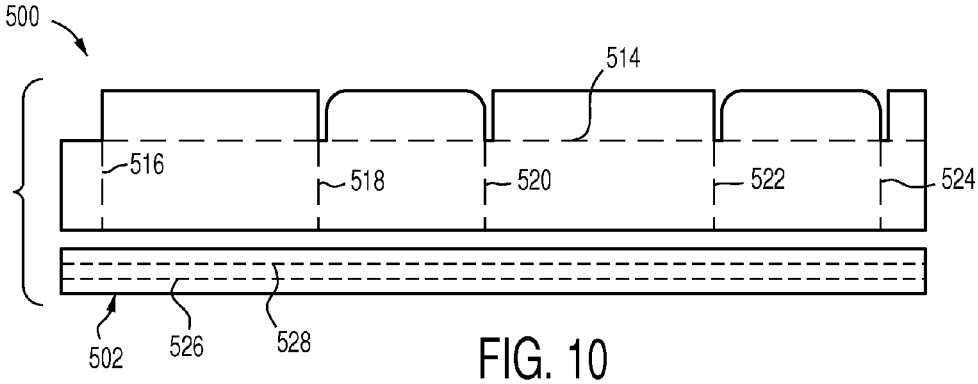
FIG. 10 is a plan view of a different blank which may be folded to form a subcontainer.

FIG. 10 shows a blank 500 which may be an alternative to the blank 400 of FIG. 9. The blank 500 may have fold lines 514, 516, 518, 520, 522, and 524, which are functional counterparts to corresponding fold lines of the blank 400. The only significant difference between the blanks 400 and 500 is that the blank 500 has a separate strip 502 bearing score lines 504, 506. The strip 502 may score lines 526, 528 have a layer of adhesive (not shown) disposed on its reverse face to facilitate assembly of a container (not shown in the erected or assembled state) from the subcontainer 500.

Figure 14:
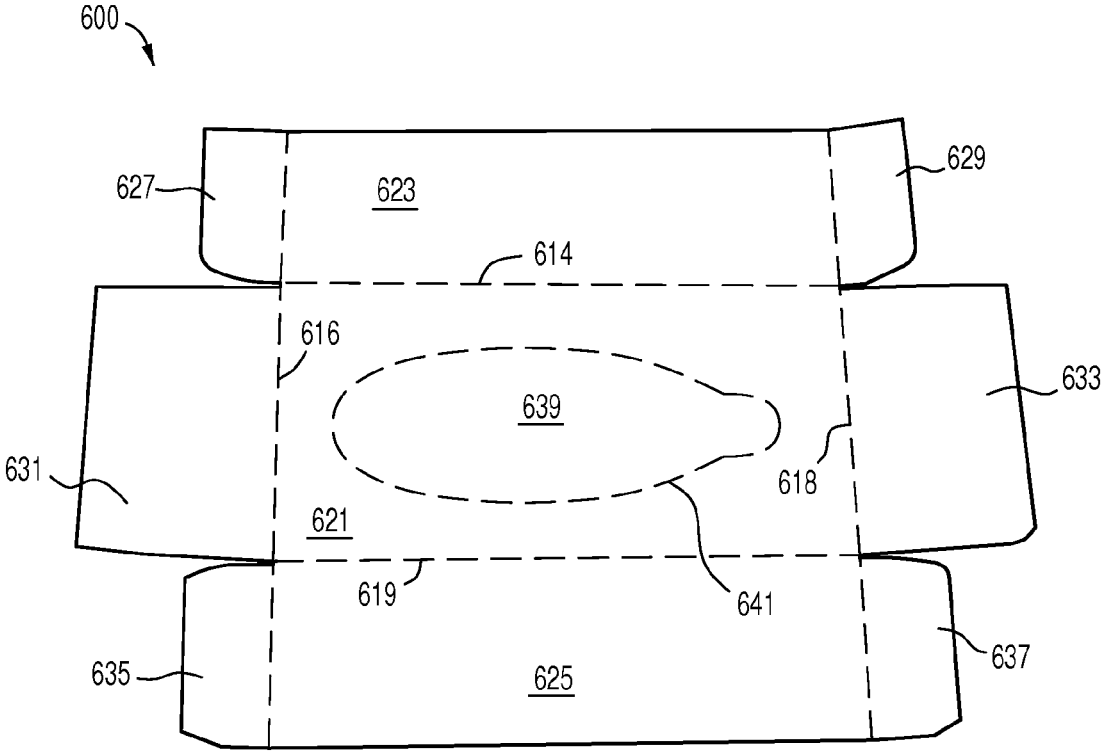
FIG. 14 is a perspective view of another blank which may be utilized to form a subcontainer according to a further aspect of the invention.

FIG. 14 shows a blank 600 which may be utilized to form a subcontainer such as the subcontainer 32. The blank 600 may have fold lines 614, 616, 618, and 619 which effectively define a main panel 621, first and second secondary panels 623 and 625, and tabs 627, 629, 631, 633, 635, and 637. The main panel 621 may have a frangible, discardable panel 639 defined by a score line 641. When folded into a subcontainer such as the subcontainer 632, the frangible, discardable panel 639 may be torn away and discarded to reveal an access opening (not shown) for retrieving contents of the subcontainer.

Containers such as the container 10 and subcontainers such as the container 32 may be fabricated from any suitable material. Heavy paper or light cardboard have traditionally been the materials of choice of manufacturers of facial wipes, facial tissues, and the like. These and many other natural or synthetic materials, such as opaque, translucent, or transparent plastics, or metals, or any combination of these may be utilized to fabricate a container, subcontainer, or an adhesive strip such as the adhesive strip 602 according to any aspect of this invention.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

We claim:

1. A pair of containers consisting of:

a base container having a floor, a peripheral wall projecting from the floor so as to define a bounded volume disposed above the floor, and a single cover panel spanning the peripheral wall so as to fully cover the bounded volume;

a subcontainer having a further peripheral wall engaged with and projecting from the single cover panel so as to define a further bounded volume disposed above the single cover panel, and a further cover panel spanning the second peripheral wall so as to fully cover the second bounded volume; and a coupling band disposed around, and exterior to, the base container adjacent the single cover panel to hold the subcontainer above and in a similar upright orientation relative to the base container, the single cover panel disposed to close a bottom of the further peripheral wall, whereby the subcontainer and the base container collectively form two coupled fully enclosed containers.

2. The container of claim 1, wherein the base container and the subcontainer are substantially of sheet material.

3. The container of claim 1, wherein the coupling band provides an air-tight seal between the base container and the subcontainer.

4. The container of claim 1, wherein the single cover panel has a first openable closure disposed to provide access to the bounded volume of the base container; and the further cover panel of the subcontainer comprises a further openable closure disposed to provide access to the further bounded volume of the subcontainer.

* * * * *